US005190152A

United States Patent [19]

Smith et al.

[11] Patent Number: 5,190,152

[45] Date of Patent: Mar. 2, 1993

[54] PORTABLE FILE BOX

[75] Inventors: Scott D. Smith, Memphis; Howard T. Rudd, Collierville, both of Tenn.

[73] Assignee: Trav-L-File, Inc., Olive Branch, Mich.

[21] Appl. No.: 899,704

[22] Filed: Jun. 17, 1992

[51] Int. Cl.[5] ..... B65D 5/50

[52] U.S. Cl. ..... 206/425; 220/338

[58] Field of Search ..... 206/425; 220/334, 337, 220/338; 312/184

[56] References Cited

U.S. PATENT DOCUMENTS

| | | | |
|---|---|---|---|
| Re. 33,231 | 6/1990 | Gallery, IV et al. | 220/337 |
| 2,430,222 | 11/1947 | Goldbert | 220/334 |
| 2,747,388 | 5/1956 | Dolar | 220/334 |
| 3,870,190 | 3/1975 | Tibbals | 220/338 |
| 3,896,962 | 7/1975 | Smith . | |
| 3,899,073 | 8/1975 | Barr . | |
| 4,154,356 | 5/1979 | Schieve . | |
| 4,301,942 | 11/1981 | Kupperman et al. | 220/338 |
| 4,529,092 | 7/1985 | Swingley, Jr. | 206/425 |
| 4,832,394 | 5/1989 | Macomber | 220/338 |
| 4,976,373 | 12/1990 | Perdue, Jr. et al. . | |

*Primary Examiner*—Jimmy G. Foster

*Attorney, Agent, or Firm*—Frank P. Presta

[57] ABSTRACT

A portable file box including sidewalls, endwalls and a bottom wall defining a box interior. The sidewalls and endwalls are provided with a rim portion on the upper ends thereof. The sidewall rim portions are flanged outwardly to define a cover side support ledge thereon and are each provided with an aperture adjacent the support ledge. The endwall rim portions are provided with downwardly extending cut-out portions therein. Two cover members are provided each having opposed laterally extending pivot members adjacent one end and a handle member extending outwardly from the other end. The cover members are arranged in end-to-end relation such that the sides are supported on the ledges, the pivot members are received in the apertures, and the handle members extend through the cut-out portions, respectively. One of the cover members can be removed from the box without removing the other. The file box may be provided with a file support ledge below the cover support ledge for suspending files therefrom. The apertures are shaped to prevent the pivot members therein from moving past each other during opening or closing movement of the cover members to preclude binding thereof.

14 Claims, 2 Drawing Sheets

PORTABLE FILE BOX

BACKGROUND OF THE INVENTION:

The present invention relates to a portable file box and, more particularly, to a portable file box provided with a support ledge on its inner perimeter for supporting a pair of cover members pivotally connected with the sides of the box.

Portable file boxes are useful for storing and transporting files containing documents or the like. A desirable feature of such file boxes is to provide a means for suspending files in the box in an organized manner which allows easy access to individual files when needed. Another desirable feature of such file boxes is to provide a cover for the box which protects the contents of the box from moisture and dust, and which enables easy access to the box interior. File boxes should to be lightweight, durable and inexpensive to manufacture.

BRIEF DESCRIPTION OF THE PRIOR ART

Portable file boxes are well known in the patented prior art as evidenced, for example, by U.S. Pat. No. 3,896,962. The '962 patent discloses a portable file box provided with means for suspending files therein, and a hinged cover which is supported on a ledge formed on the sidewalls. While the box has many desirable features, the cover requires a hinge which connects two cover members to enable the covers members to pivot. The hinge significantly increases the time and cost of manufacturing the cover, and also does not enable one cover member to be replaced if damaged without replacing the entire cover. In addition, the file box does not provide a handle for the cover which can be easily and inexpensively manufactured, and which cooperates with the box to maintain the cover in a closed position.

The present invention was developed to overcome the disadvantages of the prior art by providing a new and improved portable file box and cover which is inexpensive to manufacture and efficient in operation.

SUMMARY OF THE INVENTION

Accordingly, a primary object of the present invention is to provide a portable file box including sidewalls, endwalls and a bottom wall defining a box interior. The sidewalls and endwalls are provided with a rim portion on the upper ends thereof. The sidewall rim portions are flanged outwardly to define a cover side support ledge thereon, and the sidewalls are each provided with an aperture adjacent the support ledge. The endwall rim portions are provided with downwardly extending cut-out portions therein. Two cover members are provided each having opposed laterally extending pivot members adjacent one end and a handle member extending outwardly from the other end. The cover members are arranged in end-to-end relation such that the sides are supported on the ledges, the pivot members are received in the apertures of the sidewalls, and the handle members extend through the cut-out portions of the endwalls.

According to a more particular object of the invention, the file box is provided with a file support ledge below the cover support ledge for suspending files of the type having downwardly extending tabs on the ends of laterally projecting support arms.

A further object of the invention is to enable the handle members and endwalls to be frictionally engaged when the cover members are in a closed position.

Yet another object of the invention is to have the pivot members and the handle members integrally formed with the cover members.

Another object of the invention is to provide a cover which does not require a hinge to connect the cover members, thereby enabling the removal of one cover member from the box without removing the other.

DESCRIPTION OF THE DRAWINGS

Other objects and advantages of the subject invention will become apparent from a study of the following specification when viewed in the light of the accompanying drawings in which.

DETAILED DESCRIPTION

Figure 1:
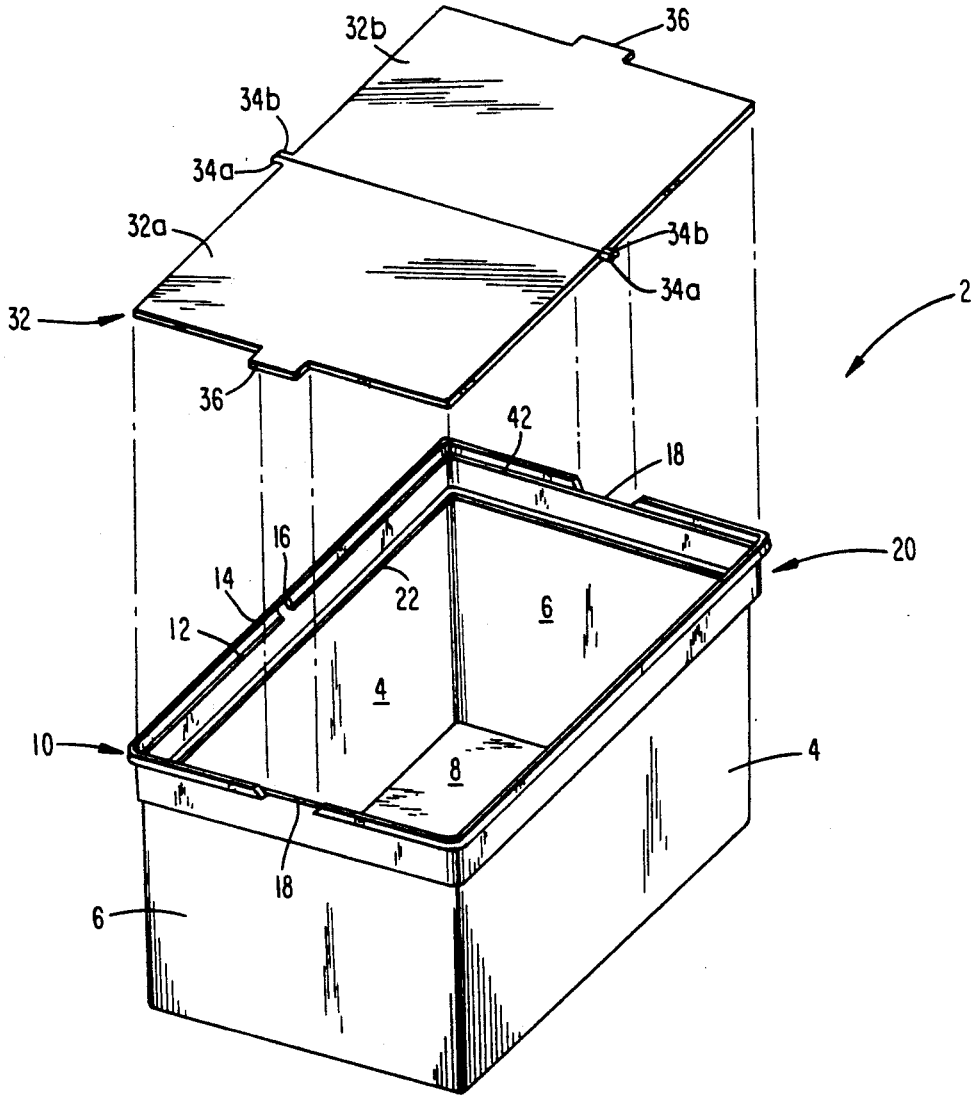
FIG. 1 is an exploded perspective view of the file box and cover members of the present invention.

Referring now to the drawings, more particularly to FIG. 1, in which like reference numerals designate similar parts throughout the various views, there is shown the file box and cover of the present invention generally designated by the numeral 2. The file box 2 includes a pair of opposed sidewalls 4, a pair of opposed endwalls 6 and a bottom wall 8 defining a box interior. The file box 2 can be made of any suitable material which is durable, light weight and inexpensive. Preferably, the sidewalls, endwalls and bottom wall are integrally formed of an injection molded, high impact synthetic plastic material.

The sidewalls 4 and endwalls 6 include a rim portion 10 which preferably is integrally formed on the upper portion thereof. The rim portion 10 is flanged outwardly on the sidewalls 4 to define a cover side support ledge 12 thereon. The rim portion 10 has an upper edge portion 14 which extends upwardly from the outside edge of the side support ledge 12 thereby defining the upper edge of the box 2. The sidewall rim portions 10 each have an aperture 16 therein located adjacent the side support ledge 12. The rim portion 10 on each of the endwalls 6 includes a downwardly extending cut-out portion 18 therein.

Figure 2:
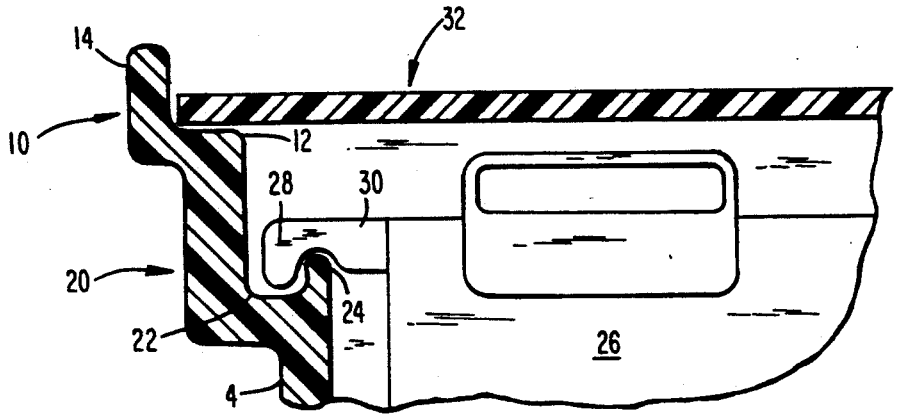
FIG. 2 is a partial sectional view of a cover member and one of the sidewalls, showing a file supported on a support ledge of the sidewall.

Referring now more particularly to FIG. 2, the sidewalls 4 preferably include a collar portion 20 which flanges outwardly from the sidewalls 4 thereby defining a file support ledge 22 below the side support ledge 12. The rim portion 10 flanges outwardly from the collar portion 20. Preferably, the file support ledge 22 includes an upwardly extending lip 24 on the inner edge thereof for enabling the file support ledge 22 to be used to support files 26 of the type having downwardly extending tabs 28 on the ends of laterally projecting support arms 30. In addition to providing support ledges 12 and 22, the flanged rim portion 10 and collar portion 20 provide a gripping means on the outside of the file box 2 for use when transporting the file box from one place to another. A cover generally designated by the numeral 32 is provided for covering the interior of the file box 2. The cover 32 includes two cover members 32*a* and 32*b* which each include a pair of opposed laterally outwardly extending pivot members 34*a* and 34*b* adjacent one end thereof and handle members 36 extending longitudinally outwardly from the other end thereof. Preferably, the pivot members 34*a* and 34*b* and the handle members 36 are integrally formed with the cover members 32*a* and 32*b* of a suitable material, such as a synthetic plastic material. The cover 32 may be made of a transparent material to allow inspection of the file box 2 contents without opening the cover 32.

Figure 3:
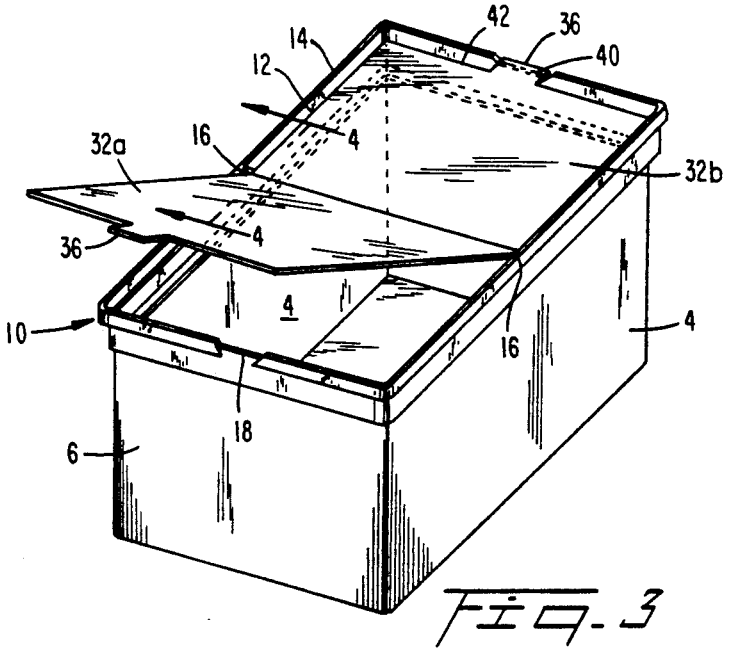
FIG. 3 is a perspective view of the file box of FIG. 1 having the cover members in place, and with one of the cover members pivoted to an open position.
Figure 4:
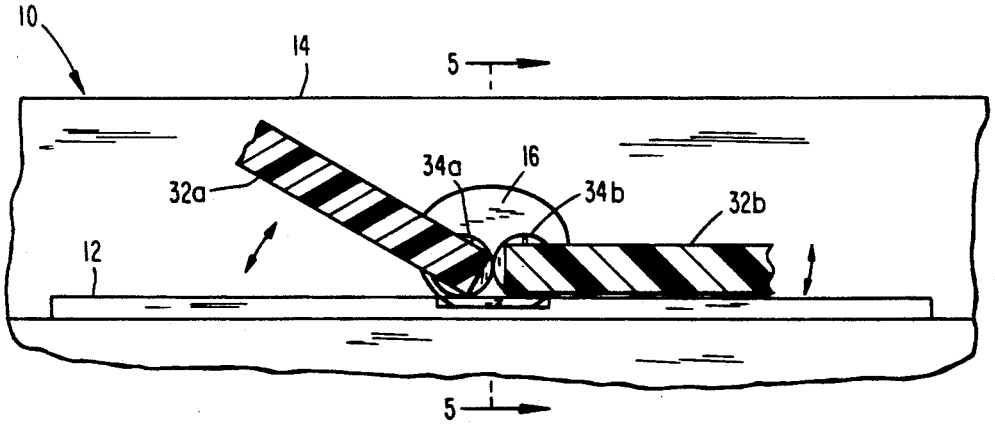
FIG. 4 is a partial sectional view of the sidewall, cover members and pivot members taken along line 4—4 of FIG. 3.

Referring now more particularly to FIG. 3, the cover members 32*a* and 32*b* are arranged in end-to-end relation, wherein each covers a portion of the file box interior. The cover members 32*a* and 32*b* are not connected to each other, thereby enabling one of the cover members to be removed from the file box 2 without removing the other. The sides of the cover members 32*a* and 32*b* are supported on the side support ledges 12, respectively. As shown most clearly in FIGS. 4 and 5, the pivot members 34*a* and 34*b* are rotatably received in the apertures 16 to enable the cover members 32*a* and 32*b* to be pivoted about the pivot members 34*a* and 34*b* to an open or closed position.

The handle members 36 extend through the cut-out portions 18 in the endwalls 6 when in the closed position to enable the cover members 32*a* and 32*b* to be easily pivoted to an open position. Preferably, the handle members 36 are textured with, for example, raised laterally extending gripping lines 40 on the upper and lower surfaces thereof for enabling the handle members 36 to be easily gripped when opening and closing the cover members 32*a* and 32*b*. The cut-out portions 18 preferably are shaped to frictionally engage the handle members 36 when in the closed position, thereby to releasably retain the cover members 32*a* and 32*b* in the closed position. The cut-out portions 18 may also include, for example, inward protrusions on the sides thereof to enable the handle members 36 to snap-fit therein.

Figure 5:
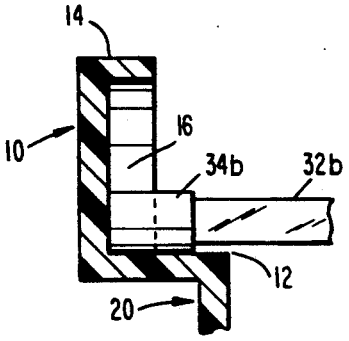
FIG. 5 is a partial sectional view of the upper portion of one of the sidewalls and the adjacent portion of a cover member taken along line 5-5 in FIG. 4.

Preferably, the apertures 16 in the sidewalls 4 only extend partially through the rim portion 10 as shown in FIG. 5, but they may extend fully through the rim portion 10 if desired. By centrally locating the apertures 16 on the length of the sidewalls 4, the cover members 32*a* and 32*b* can be made identical in size and shape to one another. Preferably, the pivot members 34*a* and 34*b* are cylindrical in shape so that they are easily rotatable to enable the cover members to smoothly open and close. The pivot members 34*a* and 34*b* should be positioned on the cover members 32*a* and 32*b* such that the ends of the cover members engage or are closely adjacent one another when the cover members are in the closed position, thereby providing a cover which is substantially waterproof and dustproof. By providing the cover members 32*a* and 32*b* as hereinbefore described, the cover will allow access to either the forward half or rearward half of the file box 2 without having to remove the entire cover 32.

Preferably, the cover members 32*a* and 32*b* are each selectively pivotable to a fully open position when the other cover member is in the closed position. When in the fully open position, the two cover members 32*a* and 32*b* are in a flat stacked relation such that one cover member is supported on the other, and each of the handle members 36 extend through a common cut-out portion 18 in one of the endwalls 6. When one of the cover members 32*a* or 32*b* is in the fully open position, preferably the cut-out portions 18 are constructed to frictionally engage both the handle members 36, thereby to releasably retain the handle member 36 therein.

Figure 6:
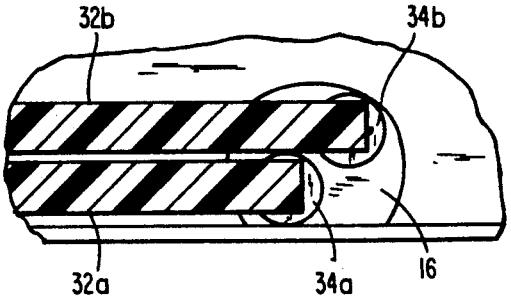
FIG. 6 is a partial sectional view of the cover members and sidewall aperture wherein one of the cover members is in a fully open position.

Preferably, the apertures 16 have a substantially oval shape wherein the width of the apertures 16 is slightly greater than, and the height of said apertures 16 is slightly less than, the combined diameters of the cylindrical pivot members 34*a* and 34*b* which are received therein, respectively. As shown most clearly in FIG. 6, by providing such oval apertures 16, the pivot members of one cover member are not able to laterally move past the pivot members of the other cover member, but instead are forced to remain substantially in their respective relative positions, thereby precluding the possibility of the cover members 32*a* and 32*b* from binding against each other during opening and closing thereof. Referring now more particularly to FIG. 6, there is shown the cover member 32*b* in a fully open position and the preferred non-binding position of the respective pivot members 34*a* and 34*b* when in the fully open position. Owing to the fact that the height of the aperture 16 is less than the combined diameters of the pivot members 34*a* and 34*b*, the pivot member 34*a* is not able to move under pivot member 34*b*, and pivot member 34*b* is not able to move over pivot member 34*a*, thereby maintaining their respective relative positions within the apertures 16. Moreover, due to the fact that the width of the apertures 16 are slightly greater than the combined diameters of pivot members 34*a* and 34*b* and the sides of the apertures 16 have a substantially curved shape, the cover members 32*a* and 32*b* can each independently be easily and smoothly pivoted to a fully closed, fully open or any other desired position therebetween without the possibility of binding on each other.

While both the endwalls 6 and the sidewalls 4 are shown in FIGS. 1 and 3 as preferably being provided with flanged rim portions 10 and collar portions 20, the provision of both of these portions on only the sidewalls 4 would be sufficient to provide satisfactory operation and utility of the present invention. By including a flanged rim portion 10 on the endwalls 6, a cover end support ledge 42 (FIG. 3) is defined for supporting the outer ends of the cover members 32*a* and 32*b*. Although a file support ledge need not be provided on the endwalls 6, the same would be useful for storing different size suspended files.

While in accordance with the patent statute, the preferred forms and embodiments of the invention have been illustrated and described, it will be apparent to those of ordinary skill in the art that various changes and modifications may be made without deviating from the inventive concepts set forth above.

What is claimed is:

1. A file box, comprising:

a pair of opposing sidewalls;

a pair of opposing endwalls;

a bottom wall;

said sidewalls, endwalls and bottom wall defining a box interior;

said sidewalls and endwalls having rim portions on the upper ends thereof, said sidewall rim portions being flanged outwardly defining cover side support ledges thereon;

said sidewall rim portions each having an aperture therein adjacent said side support ledge;

said endwall rim portions each having a downwardly extending cut-out portion therein;

first and second pivotable cover members having side portions and end portions, said cover members each having a pair of opposed laterally extending pivot members adjacent one end thereof, and a handle member extending outwardly from the other end thereof;

said cover members arranged in end-to-end relation wherein each covers a portion of said box interior, and further wherein said cover member side portions are supported on said side support ledges, said pivot members are rotatably received in said apertures, and said handle members extend through said cut-out portions when in a closed position, respectively, thereby enabling said cover members to be selectively pivoted about said pivot members to an open or closed position relative to said box interior.

2. A file box as defined in claim 1, wherein said sidewalls further include a collar portion, said collar portion being flanged outwardly to define a file support ledge below said cover side support ledge, and further wherein said rim portion is flanged outwardly from said collar portion.

3. A file box as defined in claim 2, wherein said file support ledge includes a upwardly extending lip on the inner edge thereof for use in supporting files of the type having downwardly extending tabs on the ends of laterally projecting support arms.

4. A file box as defined in claim 1, wherein said endwall rim portions are flanged outwardly defining cover end support ledges thereon, for supporting the end portions of said cover members, respectively.

5. A file box as defined in claim 1, wherein said endwall rim portions are constructed to frictionally engage said handle members in said cut-out portions when said cover members are in said closed position.

6. A file box as defined in claim 1, wherein said cover members are formed of transparent material.

7. A file box as defined in claim 1, wherein said handle members are textured to enable said handle members to be easily gripped.

8. A file box as defined in claim 1, wherein said first and second cover members are substantially identical in size and shape to one another.

9. A file box as defined in claim 8, and further wherein each of said cover members are selectively pivotable to a fully open position when the other cover member is in a closed position, wherein said cover members are in a flat stacked relation and each of said handle members extend through a common cut-out portion in one of said endwalls.

10. A file box as defined in claim 9, and further wherein each of said cut-out portions are constructed to frictionally engage both of said handle members when one of the cover members is in said fully open position, and both of said handle members are extending therethrough.

11. A file box as defined in claim 1, wherein said apertures extend only partially through said sidewall rim portions.

12. A file box as defined in claim 1, wherein said sidewalls, endwalls and bottom wall are integrally formed of synthetic plastic material.

13. A file box as defined in claim 1, wherein said pivot members and handle members are integrally formed with said cover members.

14. A file box as defined in claim 1, wherein said pivot members are substantially cylindrical in shape and said apertures are substantially oval in shape, and further wherein the width of said apertures is slightly greater than, and the height of said apertures is slightly less than, the combined diameters of the two pivot members which are received therein, respectively, whereby the pivot members of one cover member are not able to move past the pivot members of the other cover member to thereby preclude binding of said cover members during opening and closing thereof.

* * * * *